United States Patent [19]

Crossfield

[11] 4,105,569

[45] Aug. 8, 1978

[54] YARN FINISH FORMULATION

[75] Inventor: Roger J. Crossfield, Matthews, N.C.

[73] Assignee: George A. Goulston Co., Ltd., Monroe, N.C.

[21] Appl. No.: 766,281

[22] Filed: Feb. 7, 1977

[51] Int. Cl.[2] ..... D06M 13/10

[52] U.S. Cl. ..... 252/8.6; 8/115.6; 252/8.9; 428/391

[58] Field of Search ..... 252/8.6, 8.9; 8/115.6; 428/391

[56] References Cited

U.S. PATENT DOCUMENTS

| | | | |
|---|---|---|---|
| 3,306,850 | 2/1967 | Olsen | 252/8.7 |
| 3,423,235 | 1/1969 | Campbell | 428/391 |
| 3,493,425 | 2/1970 | Campbell | 428/391 |
| 3,505,220 | 4/1970 | Blabe et al. | 252/8.6 |
| 3,634,236 | 1/1972 | Buster et al. | 252/8.6 |
| 3,836,598 | 9/1974 | Wheeler | 252/8.9 |
| 3,977,979 | 8/1976 | Crossfield et al. | 252/8.6 |

*Primary Examiner*—William E. Schulz
*Attorney, Agent, or Firm*—Sughrue, Rothwell, Mion, Zinn and Macpeak

[57] ABSTRACT

Yarn finishes, particularly of the coning oil type, containing a hydrocarbon soluble, long molecular chain polymeric viscosity index improver, such as polyisobutylene, and an alkoxylated polysiloxane are disclosed.

26 Claims, No Drawings

YARN FINISH FORMULATION

BACKGROUND OF THE INVENTION

The present invention relates to yarn finish formulations applied to yarns in order to facilitate the processing of yarns, for example, the winding of yarns and the knitting and weaving of yarns into fabric. More particularly, this invention relates to yarn finish formulations containing a viscosity index improver such as a polymethacrylate, a polyalkylstyrene, an ethylene propylene copolymer or a polyisobutylene, which provides better adherence to the fiber substrate, less propensity for dripping, less finish "throw-off" during high speed winding and the like properties due to an increase in the film strength of the finish formulation at high speed winding. This invention has special reference to synthetic yarns, for example, polyester, nylon and acrylic yarns, and is described in its exemplifications with respect thereto.

Yarn finishes, which are usually multicomponent mixtures of ingredients carried in a liquid base, are applied to yarns for a number of reasons. Synthetic yarns without a finish surface coating usually cannot be processed at high speeds, are prone to break during processing, may develop static charges and often exhibit unwanted high friction levels across machinery guides and the like. Thus, a plethora of ingredients are routinely admixed and applied to the yarn surface. Antistatic agents, lubricants, emulsifiers, thickening agents, among others, are usually included in finish formulations. However, certain problems persist in the art to which the present application, as will be apparent hereinbelow, is directed.

In certain fiber processing applications, it has become highly desirable, if not necessary, to provide a finish formulation for coating yarn which is highly adherent while presenting a low friction surface on the yarn. Anti-static protection for the yarn, generally, is also needed.

In the area of yarn coning oils, particular problems are presented which are not satisfactorily dealt with by commercially available products. Coning oils are lubricants applied after yarn texturing to impart desirable properties to the yarn when subsequently handled during rewinding and by the yarn knitter or weaver. Typically, coning oils comprise blends of a base lubricant with a major proportion of an inert carrier liquid, most often mineral oil.

The base lubricant (often a blend of two or more ingredients) used in coning oils, as well as in other yarn finishes containing lubricants, should have certain properties, namely (of course, the coning oil itself should also exhibit these properties):

(1) Lubricity: a lubricant is needed which reduces the coefficient of friction between fiber-to-metal surfaces in order to prevent fiber abrasion and maintain low, uniform tension during processing;

(2) Anti-static Control: a lubricant must have an anti-static property in order to dissipate static electric charges built up during processing;

(3) Cohesion: a balanced degree of cohesion is essential since too much lubricity can cause fiber slippage resulting in package distortion in winding and other operations;

(4) Oxidation Resistance: after lubricants are applied, the fibers are often stored for prolonged periods of time; therefore, lubricants must be resistant to discoloration, bacterial growth, and formation of insoluble resinous compounds in the presence of oxygen;

(5) Scourability: since poor scourability can cause dyeing problems and potential soiling spots, lubricants must come off the yarn under mild scouring conditions and for this reason it is desirable to have a self-emulsifiable type of lubricant;

(6) Controlled Viscosity Range: too low a viscosity causes difficulties in slinging of the finish off of the yarn and low yarn frictional values while too high a viscosity causes excessive finish add-on coupled with high frictional values;

(7) Non-allergenic and Non-toxic: a lubricant must not cause any dermatological reaction since mill workers, especially at the throwster level, are constantly exposed to the neat oil, as well as finished cones of textured yarn;

(8) Odor-resistance: since yarn is often stored for relatively long periods of time, odor formation is undesirable and often intolerable;

(9) Product Stability: since mills store lubricants for long periods before use, product separation is extremely dangerous since it can go unnoticed until several thousand pounds of yarn have been treated;

(10) Corrosion Resistance: the yarn comes into contact with many metal surfaces during processing, and rusting tendencies would be detrimental to expensive machine parts; also, yarn pickup of rust deposits would cause dyeing problems;

(11) Non-volatility: product volatilization causes a percentage loss of lubricant on the yarn which results in serious knitting problems;

(12) Color: the lubricant should be water-white and non-yellowing during processing or storage of yarns, for example, at temperatures used during yarn and/or fabric stabilization and dyeing;

(13) Emulsifiable: non-uniform, unstable and difficult to emulsify lubricants perform poorly in coning oil applications, for example, in causing variable effects during winding, scouring, dyeing and the like; and

(14) Adherency: the coning oil must not be thrown off of the yarn during high speed winding operations (termed "low slinging" in the art). This problem of "sling off" is exaggerated at points along the winding path where the yarn changes direction, for example, at traverse.

Of the above listing of desirable coning oil properties, providing a finish of controlled viscosity range in relationship to low slinging propensity at acceptable frictional values has presented a perplexing problem to the industry. For example, increasing viscosity through addition of high viscosity mineral oils or heavy metal soap gelling agents, such as aluminum stearate, deleteriously affects friction level and does not provide an oil of acceptable viscosity index characteristics (viscosity index refers to thinning (lowering of viscosity) under high temperature by high frictional shear condition).

Another area presenting particularly sensitive problems regarding adherence and friction level is that of needle oils used during knitting operations. Needle oils are conventionally applied as a spray to a plurality of steel knitting needles with the objective of lubricating the needles during the knitting operation. Obviously, a highly viscous lubricant characterized by high film strength and excellent adherence to the knitting needles is needed, along with superior frictional wear protection properties and at least adequate anti-static protection to reduce charge buildup around the knitting machine. Another prime requirement is resistance to fogging during spraying. Thus, if the finish does not essentially remain on the needles in the form of a continuous lubricating film, poor lubrication and needle wear will result. Further, finish will accumulate on and around other machinery parts, presenting hazardous working conditions and difficult clean-up tasks. Obviously, some needle oil will accumulate on the knitted fabric during processing so as an additional requirement the finish must be able to be washed from the fabric during the customary scouring and/or finishing operation to which fabrics are subjected. In essence, this means water washability. As stated above with respect to coning oils, a good viscosity index is needed to prevent thinning out of the needle oil when contacted by the hot, moving knitting needles.

In order to formulate coning oils, needle lubricants and similar finishes of high film strength and fiber adherence, as well as acceptable viscosity index characteristics, it has been thought that one need only use thicker fluid solvents, perhaps in conjunction with boundary lubricants. White oil has become the accepted coning and needle oil finish base, often providing 80 percent or more by weight of the finish formulation. However, it has been found that when one employs higher viscosity white oils to thicken a coning coil, other factors remaining constant, yarn-to-metal friction increases to unacceptable values at the high yarn speeds used today in the fabric formation and yarn winding arts. Also in the case of needle oils, the high viscosity oils thin out appreciably on heating and then lose their film strength and lubricating efficiency. As stated above, the use of heavy metal soap gelling agents does not satisfactorily solve these problems.

It has been found that the addition of a small amount by weight of a hydrocarbon soluble, long molecular chain polymeric viscosity index improver to an otherwise conventional finish formulation (the polymeric material being soluble and/or dispersable in the finish formulation) increases the viscosity of the formulation without altering the anti-friction attributes of the finish, particularly as to fiber/metal friction, even during high speed yarn processing. This finding is the subject of copending application U.S. Ser. No. 692,076, filed June 2, 1976, wherein the viscosity index improver is disclosed as a polymethacrylate, a polyalkystyrene, an ethylene-propylene copolymer or a polyisobutylene. It was believed that the higher viscosity of the finish resulted in better adherence to the fiber substrate, less propensity for dripping, less finish "throw-off" during high speed winding and the like properties due to an increase in film strength of the finish formulation at high viscosity.

It has also been found that it is not necessary to raise the viscosity of conventional finish formulations in order to increase film strength and adherence to the fiber substrate, and in turn develop less propensity for dripping, less finish "throw-off" during high speed winding and like properties. One may employ a yarn finish formulation having a viscosity below that conventionally desired, raise the viscosity of the finish to the normally desired level by the addition of a long molecular chain polymeric viscosity index improver and thereby obtain the above-noted improvements. One can select a mineral oil formulation having a viscosity below that normally employed for the particular processing and raise the viscosity thereof to the value of the finish normally employed by the addition of the viscosity index improver or the yarn finish may be derived from a blend of a mineral oil having a viscosity conventionally desired and a mineral oil having a viscosity below that conventionally desired and raising the viscosity of the blend to conventional levels with a viscosity index improver. These findings are the subject of copending U.S. application Ser. No. 675,421, filed Apr. 9, 1976.

SUMMARY OF THE INVENTION

The addition of the small amount of the hydrocarbon soluble long molecular chain polymeric viscosity index improver, described above, to a yarn finish formulation is accompanied by a slight misting around the winder package during high speed winding. It is believed that this misting is due to the high surface tension of the finish. The present invention is directed to the elimination of this phenomena. The inventor has found that the addition of a small amount of a polysiloxane to the yarn finish reduces the surface tension of the finish and completely eliminates formation of the mist.

Accordingly, it is the primary object of this invention to provide a yarn finish formulation containing a hydrocarbon soluble long molecular chain viscosity index improver which is not accompanied by the formation of mist during high speed winding.

In the preferred embodiments of this invention the yarn finish formulation contains a polysiloxane which reduces the surface tension of the finish and prevents mist formation during high speed winding.

Preferably, the polysiloxane is an alkoxylated polysiloxane and more particularly, a dimethyl polysiloxane with substituted polyethylene glycol or polypropylene glycol side chains or mixed polyethylene/polypropylene glycol side chains.

DETAILED DESCRIPTION OF THE INVENTION

The present invention relates to improved yarn finishes, particularly of the type to be applied to synthetic fiber yarn. By "synthetic fiber yarns" as used herein is meant yarns or fibers which are not naturally occurring in fiber form. In other words, synthetic fibers are formed by an extrusion process regardless of whether the material forming the fiber is basically naturally-occurring (e.g., cellulose acetate) or purely synthetic (e.g., polyester and nylon fibers). This is not to say that the natural fibers in the form of spun yarns or tows may not at times be able to enjoy the benefits of the present invention (this invention may be particularly useful in the winding of natural spun yarns including blends, i.e., wool/cotton blends); however, at this time the invention's greatest utility appears to lie in the synthetic fiber area, particularly as applied to polyester, nylon and acrylic fibers. The terms "polyester," "nylon" and "acrylic" are used herein to be inclusive of all polymeric-type fibers which the artisan considers to be generically designated thereby and mixtures thereof.

As stated hereinabove, yarn finishes, e.g., coning oils and knitting needle oils having good adherence to the fiber substrate, low propensity for dripping and low "throwoff" are desirable. This type of finish is subgenerically classified as an "oil" because it is essentially non-aqueous, although at times up to about 10 to 15 percent water may be present (all percentages unless otherwise indicated are weight to weight herein). The most widely used vehicle or base for such finish oils is mineral oil, or a purified product thereof such as white oil. Therefore, the present invention is exemplified using a white oil base, although those skilled in the art will appreciate that other hydrocarbon vehicles, or even long chain synthetic esters, used as the predominant solvent carrier for nonaqueous finish formulations may be substituted for all or part of the white oil. For example, one may employ as part or all of the solvent medium straight chain esters such as hexadecyl stearate, neo esters such as trimethylpelargonate glycerol esters of long chain fatty acids, e.g., the esters of coconut oil and corn oil, and mixtures thereof. Also, finishes for other purposes, such as spun yarn finishes, may usefully enjoy the benefits of the invention where suitable. Further, the polysiloxane can be used in conjunction with finishes containing various types of thickeners and gelling agents, such as metal soaps, finishes which would usually not contain the long chain polymeric viscosity index improver.

The polysiloxane which is used to reduce the surface tension of the finish is preferably an alkoxylated polysiloxane such as a long chain dimethyl polysiloxane with polyethylene glycol or polypropylene glycol side chains or mixed polyethylene/polypropylene glycol side chains. The side chains may be substituted. The amount of substitution affects the water dispersibility or solubility. For example, the more polyethylene glycol in the side chain, the greater the water dispersability. The polysiloxanes used in the present invention are characterized by their viscosity, which can range from about 30 to about 5000 centistokes (cts) at 25° C., preferably about 50 to about 1000 cts at 25° C., most preferably about 100 to about 300 cts at 25° C.

Suitable alkoxylated polysiloxanes for use in the present invention are:

Union Carbide L 7602 (between 100 and 200 cts at 25° C) or Dow Corning FF 400, use polyethylene oxide and are water dispersible or soluble.

Union Carbide L 7000 series (about 2000–3000 cts at 25° C, e.g., L-7001) are mixed polyethylene/polypropylene glycol and can be water or oil soluble depending on the relative amounts of each.

Union Carbide L 7500 silicone (about 200 cts at 25° C.) is a preferred material for use in the present invention and is polypropylene glycol substituted and is totally oil soluble.

The polysiloxane compound is added to the finish in amounts sufficient to prevent mist formation ranging from 0.01 to 5.0% by weight, preferably 0.05 to 0.5% by weight and more preferably 0.1% by weight. It is believed that the polysiloxane lowers surface tension. This effect increases the amount of lubricant picked up by the fiber which in turn, allows one to operate at lower roll speeds. Of course, a lower roll speed will reduce oil throwoff.

White oil, unlike many of the solvents used as bases for finish oils, is available in a variety of viscosities. The most common viscosity grades employed in finish formulations are in about the 50 to 200 second range (Saybolt universal seconds at 100° F., is the viscosity measurement designation used throughout this specification except for the viscosity unit for the polysiloxane which is cts at 25° C.), or at least blends of various viscosity grade oils are used to produce a vehicle having an average viscosity in the aforementioned range.

Generally, it is desirable to work with finishes in the lower portion of the above viscosity range. Particularly with while oils, it has been found that once the viscosity of the oil reaches about 115 seconds or above, the oil appears to increase the fiber-to-metal friction of the yarn to which it has been applied. However, finishes in the lower portion of the viscosity range do not always exhibit low drip propensity, low "throwoff" and good adherence to the fiber substrate during high speed winding. Special additives may be considered to overcome this problem but present the additional consideration of interaction with other finish formulation components, cost, handling ease and the like.

The preferred white oil used is a highly refined acid-treated paraffinic oil such as the MARCOL or BAYOL series from Exxon Corporation or the CARNATION or SEMTOL series from Witco Chemical Corporation (actual products: MARCOL 70 or BAYOL 90). As mentioned before, other less highly refined mineral oils such as solvent refined pale oils or hydrogen treated oils or synthetic esters can also be employed.

The viscosities of these types of mineral oils used in coning oils range between 55 and 100 SUS at 100° F., preferably between 70 and 90 SUS.

The mineral oil of reduced viscosity is of the same family as the conventional oil described above and has a viscosity range of 25 to 70 SUS at 100° F., preferably 50 to 70. Typical products are KLEAROL (Witco Chemical Company) or MARCOL 62 (Exxon Chemical Company).

The long chain polymeric viscosity improvers are known in the motor oil art. Generally, they are either polymethacrylates, polyalkylstyrenes, polyisobutylenes or ethylene-propylene copolymers, although other polymeric types may be known. These materials, essentially inert, have been found to be useable in yarn finishes, particularly mineral oil based, to increase film strength and in turn prevent "sling off" of finish from the yarn during high speed processing.

In the preferred embodiments of this invention, the viscosity index improver is a polymethacylate, a polyalkyl styrene, an ethylene-propylene copolymer or a polyisobutylene.

In the most preferred embodiment of the invention the polymeric material is polyisobutylene essentially having only terminal unsaturation and a viscosity average molecular weight (FLORY) of about 20,000 to 1,000,000. The polyisobutylene is used in about 0.01 to 5%, preferably 0.05 to 1% by weight in an oil formulation containing 50 to 90% mineral oil.

Because polyisobutylene is the recommended polymeric viscosity improver at this time, the invention will be described in greater detail and exemplified therewith. However, it should be noted that the polyalkylstyrenes (one to ten carbon straight or branch chain alkyl group) and polymethacrylates will possess the same general characteristics regarding physical and chemical properties, for example, solubility as described for the polyisobutylenes. Molecular weight range can also be similar but would usually be within the 300,000–800,000, preferably 550,000–750,000 Flory for the polymethacrylate, the polyalkylstyrene and the ethylene-propylene copolymer.

Polyisobutylene is a highly paraffinic hydrocarbon polymer composed of long straight chain molecules. Unless modified in some manner, the polyisobutylene molecules have terminal unsaturation only, and because of this molecular structure, are relatively inert. Polyisobutylene, with agitation and heat where necessary, is soluble in most hydrocarbon solvents. It is believed that the long polyisobutylene molecular chains may be aligned somewhat haphazardly at room temperature, but become straight, extended chains at even slightly elevated temperatures and remain as such throughout all temperature ranges used in fiber processing operations. As the chain straightens out at elevated temperatures it tends to balance the viscosity decrease due to thinning of the oil. Thus, as yarns or needles become hot during processing there is less throwing or slinging off of finish. This molecular thermal stability contributes to a viscosity less dependent of temperature (lower viscosity index) once a given threshold temperature is reached. Further, the very long polymer chains are believed to contribute to the low friction level of the ultimate finish blend.

Although essentially 100% polyisobutylene polymer is preferred, the viscosity improvement additive may contain a second monomer copolymerizable with isobutylene. Any comonomer may be employed as long as it does not interfere with the viscosity improvement properties and inert character of the polyisobutylenes. For example, the polymer may contain up to about 3 percent isoprene.

The polyisobutylene may be of nearly any commercially available molecular weight. However, for ease of solubility in the hydrocarbon solvents, the semi-solid polyisobutylenes are preferred and the percentages of additive disclosed herein are for such materials. The semi-solid polyisobutylenes have a viscosity average molecular weight (Staudinger) up to about 12,000, preferably about 7,500 to 12,000. Such materials are clear, viscous, tacky, gel-like materials. Higher molecular weight rubbery solid polyisobutylenes up to about 150,000 viscosity average molecular weight (Staudinger) or over 2,000,000 (Flory), can be employed, generally with a lowering of concentration required for equivalent viscosity improvement effect.

The polyisobutylene is present in the formulation in about 0.1 to 5%, preferably 0.4 to 0.6%.

Although not entirely necessary, from the practical standpoint of time, it becomes necessary to employ heat with agitation to dissolve the polyisobutylene in the hydrocarbon solvent. For example, about up to 10% polyisobutylene can be dissolved within a few minutes in white oil heated to about 90° to 100° C with vigorous agitation. If the higher molecular weight polyisobutylenes are used, solvation ordinarily takes several hours. Very slowly, the solid polyisobutylenes imbibe solvent and swell until finally becoming semi-liquid to which additional solvent can be rapidly added.

The oil formulation may be formed of an oil formulation formed of lubricant, anti-static agent, and emulsifiers in a white oil vehicle. These agents and other finish formulation components are employed in the preparation of the multicomponent finishes in the same manner and are found therein for the same purposes as before the present invention.

Often, it has been found desirable to employ a boundary lubricant in the finish to aid the polyisobutylene in increasing the finish film strength (and to improve wearing of metal parts such as knitting needles) of the finish on the yarn. Suitable boundary lubricant additives are those employed by the artisan and compatible with other finish components, for example, the substituted and unsubstituted triaryl phosphates or alkyl phosphites, particularly the triphenyl and tricresyl phosphates. Other suitable boundary lubricants are the triaryl phosphites such as tricrescyl phosphite and synthetic esters such as butyl stearate and isopropyl palmitate.

Illustrative emulsifiers are the alkoxylated natural or synthetic alcohols ($C_{10}$–$C_{18}$) (1 to 15 moles ethylene oxide) or the alkoxylated alkyl phenols (1 to 15 moles ethylene oxide) or could be from the alkoxylated fatty acids ($C_8$–$C_{18}$) or fatty glycerides or glycol esters of fatty acids ($C_8$–$C_{18}$). Preferably the former is used in coning oils due to their lighter color. The glycol esters may be polyethylene glycol esters of $C_8$–$C_{18}$ fatty acids.

Antistat may also be used in the finish. The antistat is preferably an alkoxylated phosphated alcohol ($C_6$–$C_{18}$) sodium or potassium salt.

The following experiment was carried out to illustrate the mist formation which accompanies the addition of a viscosity index improver to a yarn finish and the elimination of the mist by the addition of a small amount of an alkoxylated polysiloxane.

EXAMPLE

Oil formulations A through D and the control were prepared as shown in Table I below. Each of the formulations was coated on a yarn in the conventional manner and the yarns were subjected to a high speed winding operation. The mist formation which accompanied each operation is shown in Table I below.

Table I illustrates that mist formation was observed during the high speed winding of the yarns coated with oils B and D which contained the viscosity index improver while no mist was observed with the control oil. This comparison indicates that mist formation is linked to the presence of the viscosity index improver in the finish.

When the yarn coated with oil A was subjected to high speed winding no mist formation was observed, thereby demonstrating the effect of the polysiloxane on mist formation. The comparison of the "throw off" observed during the runs made with oils A, B and C indicates that the presence of the polysiloxane does not adversely affect the improved adherence of the finish to the fiber substrate which accompanies the addition of the viscosity index improver.

TABLE I

OIL FORMULATIONS

| Formula | Function | Parts By Weight | | | | |
|---|---|---|---|---|---|---|
| | | Control | Oil A | Oil B | Oil C | Oil D |
| 80 SUS White Oil (Witco Carnation) | lubricant | 84.00 | 83.45 | 83.55 | 83.90 | 83.4 |
| Polyisobutylene (Vistanex LM-MS) | sling control additive | 0 | 0.45 | 0.45 | 0 | 0.6 |
| Polypropoxylated Polysiloxane (L 7500, Union Carbide Corp.) | wetting agent | 0 | 0.10 | 0 | 0.10 | 0 |
| POE(3) $C_{12}/C_{13}$ Alcohol (Neodol 23-3, Shell Chemical Co.) | emulsifier | 12.00 | 12.00 | 12.00 | 12.00 | 12.00 |
| POE (6.5) $C_{12}/C_{13}$ Alcohol (Neodol 23 - 6.5, Shell Chemical Co.) | emulsifier | 3.20 | 3.20 | 3.20 | 3.20 | 3.20 |
| Water | clarifying agent | 0.80 | 0.80 | 0.80 | 0.80 | 0.80 |
| Resultant Viscosities (SUS at 100° F) | | 86 | 87 | 86 | 86 | 86 |

TABLE I-continued

OIL FORMULATIONS

| Subjective comparison of slinging and misting | Parts By Weight | | | | |
|---|---|---|---|---|---|
| | Control | Oil A | Oil B | Oil C | Oil D |
| Throwoff onto floor | excessive | none | slight | excessive | none |
| Throwoff at tension gate | excessive | none | slight | excessive | none |
| Misting above spindle | none | none | slight | none | excessive |

Additives conventional to the types of formulation under consideration are usable in the present invention, as long as compatible with remaining ingredients. For example, the emulsifier, antistat, boundary lubricant or the like components can vary widely and those discussed hereinbefore are only illustrative.

While the invention has been described in detail and with reference to specific embodiments thereof, it will be apparent to one skilled in the art that various modifications are possible without departing from the spirit and scope thereof.

What is claimed is:

1. In a yarn finish formulation comprising a major amount of a mineral oil and a minor viscosity improvement amount of a long molecular chain polymeric viscosity index improver, the improvement comprising a minor surface tension and mist reduction amount of a polysiloxane present in said yarn finish formulation.

2. The finish of claim 1, wherein said polysiloxane is an alkoxylated polysiloxane.

3. The finish of claim 1, wherein said polysiloxane has a viscosity of about 30 to about 5000 centistokes at 25° C.

4. The finish of claim 3 wherein said polysiloxane has a viscosity of about 50 to about 1000 centistokes at 25° C.

5. The finish of claim 4 wherein said polysiloxane has a viscosity of about 100 to about 300 centistokes at 25° C.

6. The finish of claim 3, wherein said polysiloxane has a dimethyl polysiloxane main chain alkoxylated with side chains of polyethylene glycol, polypropylene glycol or mixed polyethylene glycol polypropylene glycol.

7. The finish of claim 6, wherein said polysiloxane is present in an amount of 0.01 to 5.0% by weight.

8. The finish of claim 1, wherein said mineral oil is a white oil having a viscosity of about 50 to 200 seconds.

9. The finish of claim 6, wherein said polymeric viscosity index improver is selected from the group consisting of polymethacrylate, polyalkylstyrene, ethylene-propylene copolymer, and polyisobutylene.

10. The finish of claim 9, wherein said polymeric viscosity index improver is polyisobutylene.

11. The finish of claim 10, wherein said polyisobutylene has a molecular weight of 7500 to 12,000 (Staudinger) and is present in an amount of 0.01 to 5% by weight.

12. The finish of claim 4, wherein said alkoxylated polysiloxane has a dimethyl polysiloxane main chain alkoxylated with side chains of polyethylene glycol, polypropylene glycol or mixed polyethylene glycol polypropylene glycol.

13. The finish of claim 12, wherein said polysiloxane is present in an amount of 0.01 to 5.0% by weight.

14. The finish of claim 12, wherein said polymeric viscosity index improver is selected from the group consisting of polymethacrylate, polyalkylstyrene, ethylene-propylene copolymer, and polyisobutylene.

15. The finish of claim 14, wherein said polymeric viscosity index improver is polyisobutylene.

16. The finish of claim 15, wherein said polyisobutylene has a molecular weight of 7500 to 12,000 (Staudinger) and is present in an amount of 0.01 to 5% by weight.

17. The finish of claim 6, wherein said polysiloxane has dimethyl polysiloxane main chain alkoxylated with side chains of polyethylene glycol, polypropylene glycol or mixed polyethylene glycol polypropylene glycol.

18. The finish of claim 17, wherein said said polysiloxane is present in an amount of 0.01 to 5.0% by weight.

19. The finish of claim 5 wherein said mineral oil is a white oil having a viscosity of about 50 to 200 seconds.

20. The finish of claim 19, wherein said polymeric viscosity index improver is polyisobutylene.

21. The finish of claim 20, wherein said polyisobutylene has a molecular weight of 7500 to 12,000 (Staudinger) and is present in an amount of 0.01 to 5% by weight.

22. A yarn carrying the finish of claim 3.

23. A yarn carrying the finish of claim 4.

24. A yarn carrying the finish of claim 5.

25. The finish of claim 1 included a compatible emulsifier.

26. The finish of claim 17 wherein said polymeric viscosity index improver is selected from the group consisting of polymethacrylate, polyalkylstyrene, ethylene-propylene copolymer, and polyisobutylene.

* * * * *